US007093865B2

(12) United States Patent
Furuya

(10) Patent No.: US 7,093,865 B2
(45) Date of Patent: Aug. 22, 2006

(54) LID LOCKING APPARATUS

(75) Inventor: Takahiro Furuya, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 102 days.

(21) Appl. No.: 11/004,524

(22) Filed: Dec. 3, 2004

(65) Prior Publication Data

US 2005/0132768 A1 Jun. 23, 2005

(51) Int. Cl.
*E05C 19/10* (2006.01)

(52) U.S. Cl. ..... 292/128; 292/96; 292/121; 292/202; 292/210; 292/228; 292/304; 292/DIG. 61; 296/24.34

(58) Field of Classification Search ..... 292/128, 292/24, 31, 54, 95, 96, 101, 108, 121, 195, 292/202, 210, 219, 228, 304, DIG. 11, DIG. 30, 292/DIG. 61, DIG. 63; 296/24.34, 37.12
See application file for complete search history.

(56) References Cited

U.S. PATENT DOCUMENTS

| | | | | | |
|---|---|---|---|---|---|
| 30,397 | A | * | 10/1860 | Finch | 292/31 |
| 336,054 | A | * | 2/1886 | Kohn | 292/24 |
| 558,972 | A | * | 4/1896 | Meyer | 292/98 |
| 667,521 | A | * | 2/1901 | Hill | 292/24 |
| 767,567 | A | * | 8/1904 | Keil | 292/127 |
| 1,216,414 | A | * | 2/1917 | Calkins | 292/111 |
| 2,028,954 | A | * | 1/1936 | Roedding | 292/126 |
| 2,948,560 | A | * | 8/1960 | Rop | 292/45 |
| 3,161,923 | A | * | 12/1964 | Crain | 292/128 |
| 3,455,590 | A | * | 7/1969 | Zerfoss | 292/128 |
| 4,502,715 | A | * | 3/1985 | Lundblade | 292/78 |
| 5,775,140 | A | * | 7/1998 | Hallsten | 70/85 |
| 5,957,511 | A | * | 9/1999 | Homann et al. | 292/196 |
| 6,550,824 | B1 | * | 4/2003 | Ramsauer | 292/126 |
| 6,802,550 | B1 | * | 10/2004 | Griggs et al. | 296/24.34 |
| 6,942,257 | B1 | * | 9/2005 | Wong et al. | 292/128 |

FOREIGN PATENT DOCUMENTS

| | | | |
|---|---|---|---|
| DE | 4309620 | * | 9/1994 |
| JP | 06-081527 | | 3/1994 |
| JP | 08-207668 | | 8/1996 |
| JP | 11-034747 | | 2/1999 |

* cited by examiner

*Primary Examiner*—Brian E. Glessner
*Assistant Examiner*—Carlos Lugo
(74) *Attorney, Agent, or Firm*—Rankin, Hill, Porter & Clark LLP

(57) ABSTRACT

A lid locking apparatus has a storage member, a lid, a knob member having a first abutment portion, a lock member having a second abutment portion and first and second biasing members. When the lid is in a closed position, the lock member locks the lid, when the knob member is in a closed position, the first biasing member biases the first and second abutment portions so as to abut each other, when the knob member is opened, the first biasing member biases to swing the lock member and the knob member integrally to thereby release the locked state, and when the lid is closed, the second biasing member biases the knob member in a direction towards the closed position to separate the abutment portions to thereby allow the lock member to swing independently even in the locked state.

11 Claims, 7 Drawing Sheets

LID LOCKING APPARATUS

The present invention claims foreign priority to Japanese patent application no. P.2003-420876, filed on Dec. 18, 2003, the contents of which is incorporated herein by reference.

BACKGROUND OF THE INVENTION

1. Field of the Invention

The present invention relates to a lid locking apparatus for locking and unlocking a lid for opening and closing an opening in a storage portion provided in a vehicle to and from the storage portion.

2. Description of the Related Art

As techniques for locking and unlocking a lid for opening and closing an opening in a storage portion provided in a vehicle to and from the storage portion, there exist a technique in which a knob portion that is operated to be opened and closed and a lock portion that is brought into engagement with an engagement portion on the storage portion side are formed into a single integrated structure (for example, refer to Japanese Patent Unexamined Publication JP-A-6-81527) and a technique in which the knob portion and the lock portion are formed as separate structures (for example, refer to Japanese Patent Unexamined Publication JP-A-8-207668 and Japanese Patent Unexamined Publication JP-A-11-34747).

In the technique in which the knob portion and the lock portion are formed into a single integrated structure, a spring is provided for bringing the lock portion into engagement with the engagement portion and biasing the knob portion in a direction in which the knob portion is held at a closed position. When the knob portion is operated to be opened against the basing force of the spring, the lock portion is swung together with the knob portion so as to cancel the engagement with the engagement portion. With the locking apparatus constructed as is described in the JP-A-6-81527, when the lock portion rides on the engagement portion to be locked at the closing operation of the lid, the knob portion is swung together. As a result, when the lid is operated to be closed while the knob portion is being grabbed by the occupant, the knob portion is swung, and the occupant, who is grabbing the knob portion, is caused to feel a feeling of physical disorder.

In addition, in the technique in which the knob member and the lock member are formed as the separate structures, a spring is provided for biasing the lock member in a direction in which the lock member is brought into engagement with the engagement portion. The biasing force of the spring is designed to be transmitted to the knob member via the lock member in a direction in which the knob member is held at the closed position. When the knob member is operated to be opened against the biasing force of the spring, the lock member is pushed by the knob member to thereby be swung, so that the engagement with the engagement portion is released. With the locking apparatus constructed as described in the JP-A-8-207668 and JP-A-11-34747, when the lock member rides on the engagement portion to be locked at the closed operation of the lid, since the construction is adopted in which the knob member and the lock members are formed as the separate members, the knob member is prohibited to be swung together. The problem inherent in the construction in which the knob portion and the lock portion are formed into the single integrated structure is solved.

In the technique in which the knob member and the lock member are formed as the separate structures. However, since the biasing force of the spring for biasing the lock member is designed to be transmitted to the knob member via the lock member, when the lock member rides on the engagement portion to be locked at the closed operation of the lid, the biasing of the knob member by the spring is cancelled by virtue of the action of the lock member, whereby looseness is allowed to be generated in the knob member. Accordingly, when the lid is closed while the knob member is being grabbed by the occupant, looseness is generated in the knob member. In this point, the occupant is forced to feel a feeling of physical disorder in the operation.

SUMMARY OF THE INVENTION

Consequently, an object of the invention is to provide a lid locking apparatus which can obtain a good operation feeling by preventing the swing of the knob member and even the generation of looseness in the knob member, when the lid is operated to be closed.

With a view to attaining the object, according to a first aspect of the invention, there is provided a lid locking apparatus comprising:

a storage member having an opening portion and an engagement portion;

a lid which opens or closes the opening portion;

a knob member swingably supported on the lid via a first shaft, the knob member having a first abutment portion;

a lock member swingably supported on the knob member via a second shaft, the lock member having a second abutment portion and first and second biasing members, wherein when the lid is in a closed position, the lock member locks the lid by engaging with the engagement portion, when the knob member is in a closed position, the first biasing member biases the first and second abutment portions so as to abut each other to thereby lock the lid with the lock member, when the knob member is opened from the closed position, the first biasing member biases to swing the lock member and the knob member integrally with the first and second abutment portions being held in abutment each other to thereby release the engagement with the engagement portion and the lock member, and when the lid is closed, the second biasing member biases the knob member in a direction towards the closed position thereof to separate the first and second abutment portions each other against the biasing force of the first biasing member to thereby allow the lock member to swing independently even in the event that the lock member rides on the engagement portion.

According to a second aspect of the present invention according to the first aspect of the present invention, it is preferable that the first and the second biasing members are formed of a single spring.

According to a third aspect of the present invention according to the second aspect of the present invention, it is more preferable that the spring is disposed so as to contact with the lid, the knob member and the lock member.

According to a fourth aspect of the present invention according to the second aspect of the present invention, it is furthermore preferable that the spring is a plate spring.

According to a fifth aspect of the present invention according to the first aspect of the present invention, it is suitable that the knob member and the lock member are formed separately.

According to a sixth aspect of the present invention according to the first aspect of the present invention, it is more suitable that the first abutment portion is provided on a surface of the knob member which opposes to the lock member.

According to a seventh aspect of the present invention according to the first aspect of the present invention, it is further suitable that when the first and second abutment portions abut each other, the knob member and the lock members are restricted from swinging in an abutment direction.

According to an eighth aspect of the present invention according to the first aspect of the present invention, it is suitable that the storage member includes a main body portion and a storage portion, and the storage portion is swingably supported on the main body portion.

According to a ninth aspect of the present invention according to the eighth aspect of the present invention, it is suitable that the engagement portion is provided on the main body portion, and the opening is provided on the storage portion.

According to a tenth aspect of the present invention according to the first aspect of the present invention, it is suitable that the knob member includes:

a connecting portion which connects to the lock member;

an operable portion which extends so as to be substantially parallel to the lid; and an extending portion which extends from an intermediate portion of the operable portion toward the lid.

According to an eleventh aspect of the present invention according to the tenth aspect of the present invention, it is suitable that the first and second biasing members are formed of a single spring having a curvature portion, and the curvature portion is disposed between the connecting portion and the intermediate portion.

According to the first aspect of the invention, when the knob member of the lid is operated to be opened in order to open the lid, which is closing the opening in the storage portion, the knob member swings about the first shaft which supports the knob member on the lid in such a manner as to swing. As this occurs, the abutment structure portions provided on the lock member, which is supported on the knob member by the second shaft in such a manner as to swing, and the knob member are brought into abutment with each other by virtue of the biasing force of the first biasing means, and as a result, the lock member swings together with the knob member to thereby release the engagement with the engagement portion, whereby the lid can be opened. On the other hand, even in the event that the lock member rides on the engagement portion to swing, when the lid is operated to be closed from the opened state, since the second biasing means biases the knob member in the direction towards the closed position in an attempt to force the abutment structure portions to separate from each other against the biasing force of the first biasing means so as to allow the lock member to swing independently, the knob member continues to be biased to stay at the closed position. Consequently, when the lid is operated to be closed, the swing of the knob member and the generation of looseness in the knob member can be both prevented.

According to the second aspect of the invention, since the first biasing means and the second biasing means are formed of the single spring, the number of components and costs can be reduced.

DETAILED DESCRIPTION OF THE PREFERRED EMBODIMENTS

Referring to FIGS. 1 to 6, a lid locking apparatus of a first embodiment of the present invention will be described hereinafter.

Figure 1:
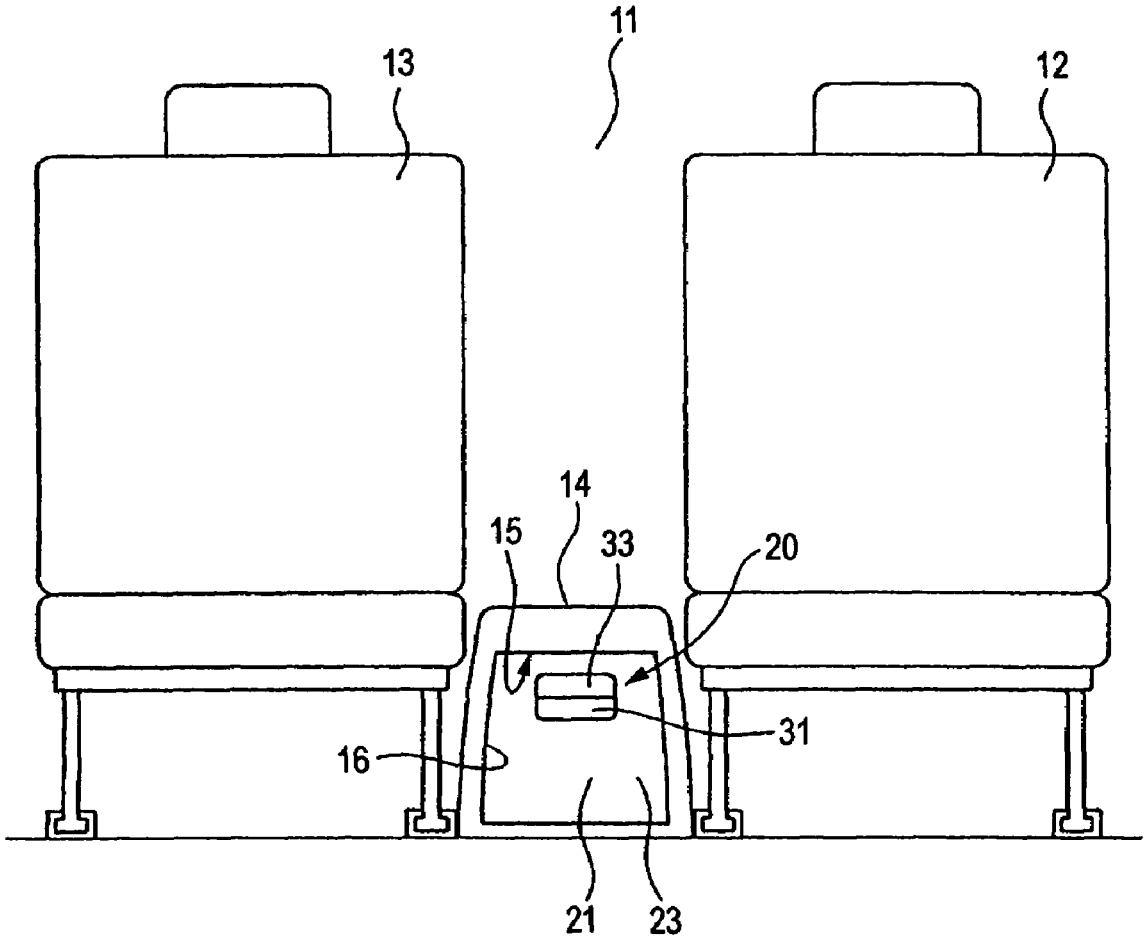
FIG. 1 is a view showing a center console and the periphery to which a lid locking apparatus of an embodiment of the present invention is applied when viewed from the rear of a vehicle.

As shown in FIG. 1, a center console 14 is provided between a driver seat 12 and a front passenger seat 13 in a passenger compartment 11 of a vehicle. A console-side storage portion (a storage portion) 15 is provided in the center console 14 for use mainly by occupants on a rear seat, which is not shown. This console-side storage portion 15 has an opening 16 which is made to open towards the rear seat side. A lid locking apparatus 20 of the first embodiment is designed to lock and unlock a lid 21 for opening and closing the opening 16 in the console-side storage portion 15 to and from the console-side storage portion 15. Note that in the following description, the opening direction of the lid 21 is described as being directed towards front, and the closing direction of the lid 21 is described as being directed towards rear, and hence front and rear in the following description are opposite to front and rear which are used to describe the longitudinal direction of the vehicle.

Figure 2:
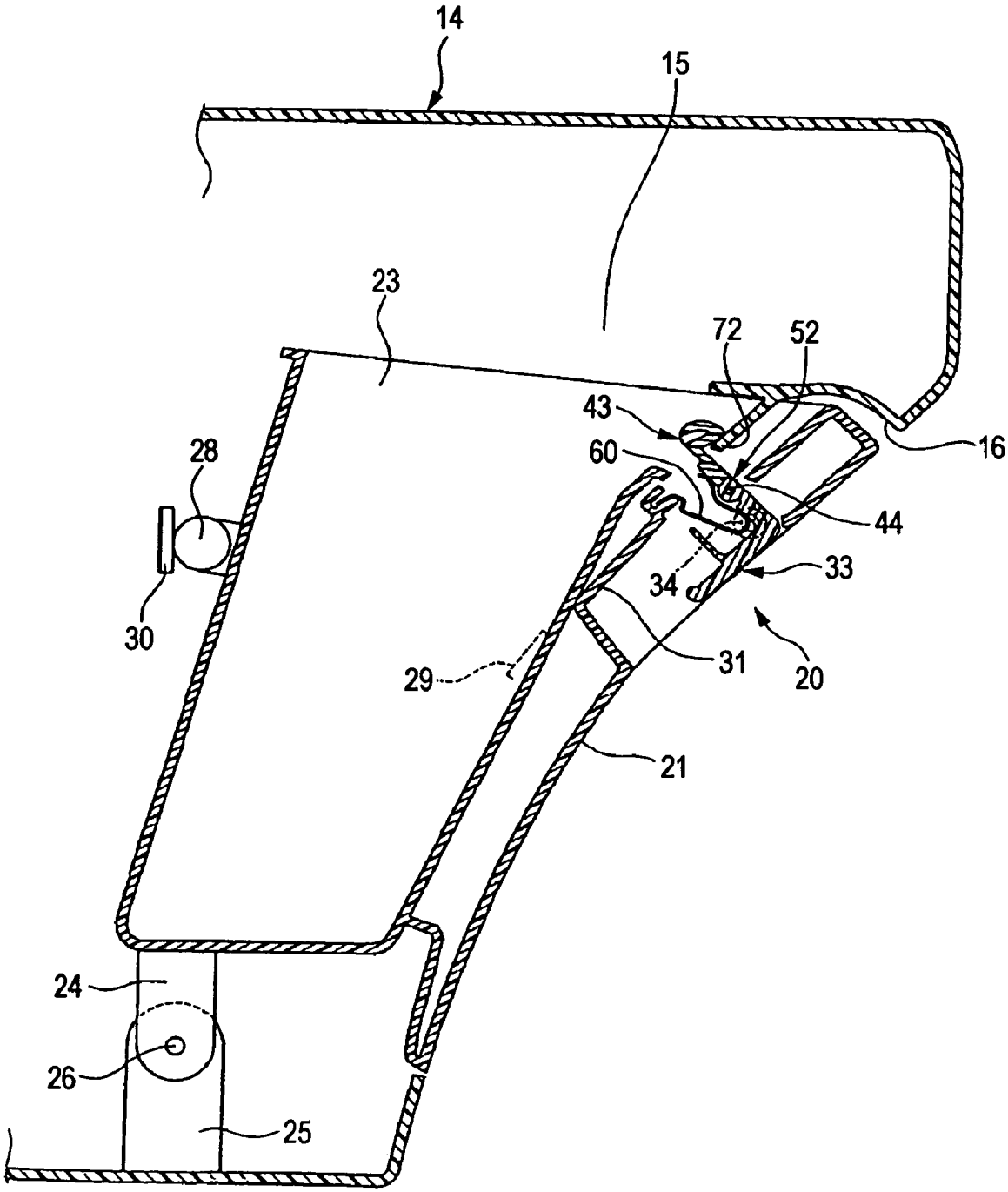
FIG. 2 is a side cross-sectional view of the lid locking apparatus and the periphery of the embodiment of the present invention.

As shown in FIG. 2, the lid 21 is formed integrally with a storage box 23, which opens upwardly, so as to constitute a front surface of the storage box 23. In this storage box 23, a connecting piece portion 24 formed on a bottom part of the storage box 23 is connected to a support portion 25 within the console-side storage portion 15 via a support shaft 26 which follows a transverse direction of the vehicle, so that the storage box 23 swings about the support shaft 26. In addition, swing limit positions of the storage box 23 are determined by the abutment of a stopper pin portion 28 provided on a transverse side of the storage box 23 against stopper portions 29, 30 formed within the console-side storage portion 15. To be specific, the storage box 23 swings about the support shaft 26 between a projecting state and a retracted state. Wherein the projecting state is defined that the storage box 23 projects from the opening 16 in the console-side storage portion 15 until the stopper pin portion 28 comes to abut against the stopper portion 29, and the retracted state is that the storage box 23 is retracted in the console-side storage portion 15 until the stopper pin portion 28 comes to abut against the stopper portion 30.

Figure 3:
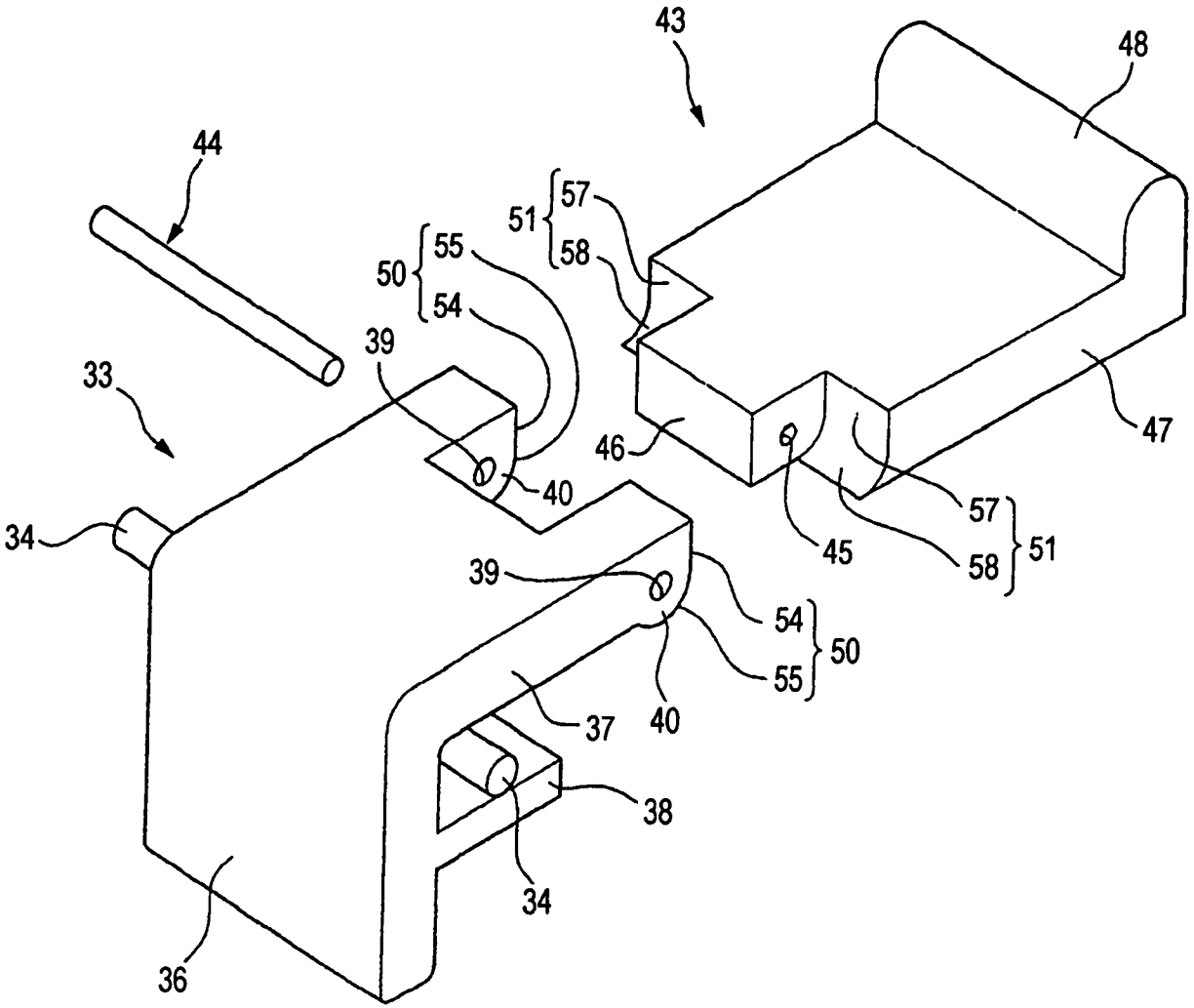
FIG. 3 is an exploded perspective view showing a knob member and a lock member of the lid locking apparatus of the embodiment of the present invention.
Figure 4:
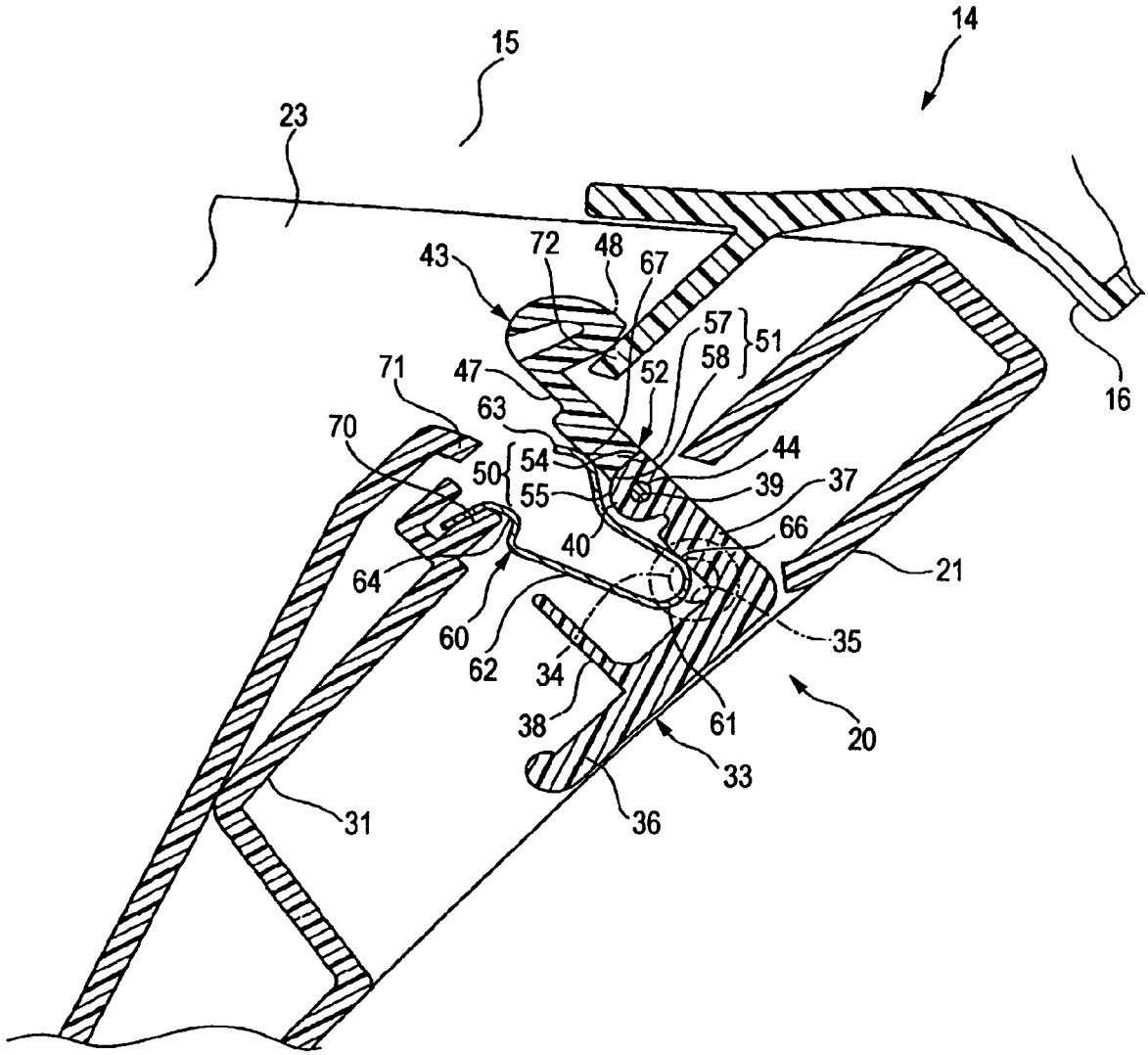
FIG. 4 is an enlarged side cross-sectional view showing an inoperative state of the lid locking apparatus of the embodiment of the present invention.

A recessed portion 31 is formed in the lid 21 provided on the front surface of the storage box 23 at an upper portion and a transversely central position. A knob member 33 of the lid locking apparatus 20 is disposed at an upper portion within the recessed portion 31. This knob member 33 is supported within the recessed portion 31 in such a manner as to swing by supporting rotatably support shaft portions 34 i.e. a first shaft, which are provided coaxially on both sides of the knob member 33 in support holes 35 formed in transverse sides of the recessed portion 31 in the lid 21, as shown in FIGS. 3 and 4. Accordingly the knob member 33 swings about the support shaft portions 34 around an axis which follows the transverse direction of the vehicle.

The knob member 33 has an operation plate portion 36, an engagement plate portion 37 and an intermediate plate portion 38.

Wherein the operation plate portion 36 extends along a direction which intersects with an axis of the support shaft portions 34 at right angles while following the support shaft portions 34.

Wherein the engagement plate portion 37 extends in a direction which intersects with the axis of the support shaft portions 34 at right angles from the support shaft portions 34 side of the operation plate portion 36. Also the engagement plate portion 37 extends in a direction which intersects with the operation plate portion 36 at right angles while following the support shaft portions 34.

Wherein the intermediate plate portion 38 extends from an intermediate position on the operation plate portion 36 in a direction which follows the direction in which the engagement plate portion 37 extends.

In addition, a pair of connecting piece portions 40 are provided at an opposite end portion of the engagement plate portion 37 in respect to the operation plate portion 36. The connecting piece portions 40 projects towards an opposite direction to the operation plate portion 36. Further, a connecting hole 39 which is parallel to the support shaft portions 34 is formed on the connecting piece portions 40 is parallel to the support shaft portions 34. Here, when the knob member 33 is supported on the lid 21, in the knob member 33, the operation plate portion 36 and the engagement plate portion 37 follow the transverse direction of the vehicle at the upper portion in the recessed portion 31.

A lock member 43 of the lid locking apparatus 20 is supported on the knob member 33 so as to swing. This lock member 43 has an insert portion 46 having a pass hole 45 formed to allow the passage of a pin 44 i.e. a second shaft. The lock member 43 is supported so as to swing about the pin 44 by striking the pin 44 into the knob member 33 from one of the connecting holes 39 in the knob member 33 to pass the pin 44 through the pass hole 45 to thereafter strike it into the other connecting hole 39 while the insert portion 46 is inserted between the pair of connecting piece portions 40. The lock member 43 has an extending plate portion 47 and a locking pawl portion 48. Where in the extending plate portion 47 extends from the insert portion 46 in a direction which intersects with an axis of the pin 44 at right angles while following the pin 44. Wherein the locking pawl portion 48 extends perpendicularly relative to the extending plate portion 47 from an end of the extending plate portion 47 which is opposite to the pin 44.

Here, abutment structure portions 52 which can be brought into abutment with and separation from each other, are provided on end faces 50 and end faces 51. Wherein the end faces 50 of the connecting piece portions 40 of the knob member 33 are opposite to the operation plate portion 36. The end faces 51 of the extending plate portion 47 of the lock member 43 are opposite to the locking pawl portion 48. Namely, the end face 50 of the knob member 33 has a flat abutment surface portion 54 which is an opposite side of the operation plate portion 36 to the extending direction of the operation plate portion 36 and curved portion 55 which is a side of the operation plate portion 36.

In addition, the end face 51 of the lock member 43 has a flat abutment surface portion 57 which is a projecting side of the locking pawl portion 48 and a curved surface portion 58 which is an opposite side of the projecting pawl portion 48 and is concentric with the curved surface portion 55 of the operation plate portion 36.

The abutment structure portion 52 is constituted by the abutment surface portion 54 of the knob member 33 and the abutment surface portion 57 of the lock member 43. In an abutment state where these abutment surface portions 54, 57 are brought into abutment with each other, the engagement plate portion 37 of the knob member 33 and the extending plate portion 47 of the lock member 43 are disposed on the same plane, while the operation plate portion 36 of the knob member 33 and the locking pawl portion 48 of the lock member 43 are disposed on opposite sides to each other relative to the engagement plate portion 37 and the extending plate portion 47. While it goes without saying, in this abutment state, the knob member 33 and the lock member 43 are restricted from being swung further in the abutment direction. Since the curved surface portions 55, 58 are concentric with each other, the knob member 33 and the lock member 43, are allowed to swing about the pin 44 from the abutment state in directions in which the abutment surface portions 54, 57 are forced to be separated from each other.

In the lid locking apparatus 20 according to the first embodiment, in a state in which the knob member 33 to which the lock member 43 is connected via the pin 44 is supported on the lid 21 at the support shaft portions 34, a spring 60, that is a first biasing member and a second biasing member, for biasing the knob member 33 and the lock member 43 is provided underneath the knob member 33 and the lock member 43.

This spring 60 is a so-called plate spring and is formed into an overall shape in which the spring is bent back at an arc-like portion 61 at an intermediate position thereof. Namely, the spring 60 is shaped such that a flat plate-like first plate portion 62 is provided on one side of the arc-like portion 61. A wavy plate-like second plate portion 63 is provided on the other side of the arc-like portion 61. A locking recessed portion 64, which is bent so as to form a recessed shape which is made to open to an opposite side to the second plate portion 63, is formed at an end of the first plate portion 62 which is opposite to the arc-like portion 61. In addition, the spring 60 is shaped such that, on the second plate portion 63, a first abutting raised portion 66, which is bent so as to form a raised shape on an side of the second plate portion 63 which is opposite to the first plate portion 62, is formed at the arc-like portion 61 side. A second abutting raised portion 67, which is bent so as to form a raised shape on the opposite side of the second plate portion 63 to the first plate portion 62, is formed at an opposite end to the arc-like portion 61.

Then, the spring 60 is locked on the lid 21 side at one end thereof with a locking piece portion 70, which projects upwardly in the recessed portion 31 in the lid 21 being inserted into the locking recessed portion 64, whereby the first plate portion 62 is caused to extend in the direction of the operation plate portion 36 of the knob member 33. In the spring 60, the arc-like portion 61 is bent back at the position just before the operation plate portion 36, and the second plate portion 63 abuts against bottom surfaces of the engagement plate portion 37 of the knob member 33 and the extending plate portion 47 of the lock member 43. Here, the first abutting raised portion 66 on the second plate portion 63 abuts against the lock member 43 side rather than the support shaft portions 34 on the engagement plate portion 37 of the knob member 33 to thereby push the lock member 43 upwardly when deformed. In addition, the second abutting raised portion 67 on the second plate portion 63 abuts against the locking pawl portion 48 side rather than the pin 44 on the extending plate portion 47 of the lock member 43 to thereby push the locking pawl portion 48 upwardly when deformed. Note that a stopper portion 71, which determines a swing limit position of the lock member 43, is disposed on the storage box 23 at a position behind the locking piece portion 70.

In an inoperative state shown in FIG. 4 in which the lock member 43 and the knob member 33 are biased by the spring 60, the lock member 43 and the knob member 33 are stopped at a predetermined closed position with the abutment structure portions 52 being in abutment with each other. In this closed position, the knob member 33 takes a posture in which the operation plate portion 36 follows the front surface of the lid 21 and the engagement plate portion 37 thereof and the lock member 43 extend rearward. In this state, when the storage box 23 is in the retracted state in which the storage box 23 is retracted into the console-side storage portion 15, the locking pawl portion 48 of the lock member 43 is brought into engagement with a rear side of an engagement portion 72 which extends downwardly into the console-side storage portion 15. In this state, the forward movement of the locking pawl portion 48 is restricted by the engagement portion 72, whereby the swing of the storage box 23 and the lid 21 towards the projecting state direction is restricted. As this occurs, the lid 21 closes the opening 16 in the console-side storage portion 15.

Figure 5:
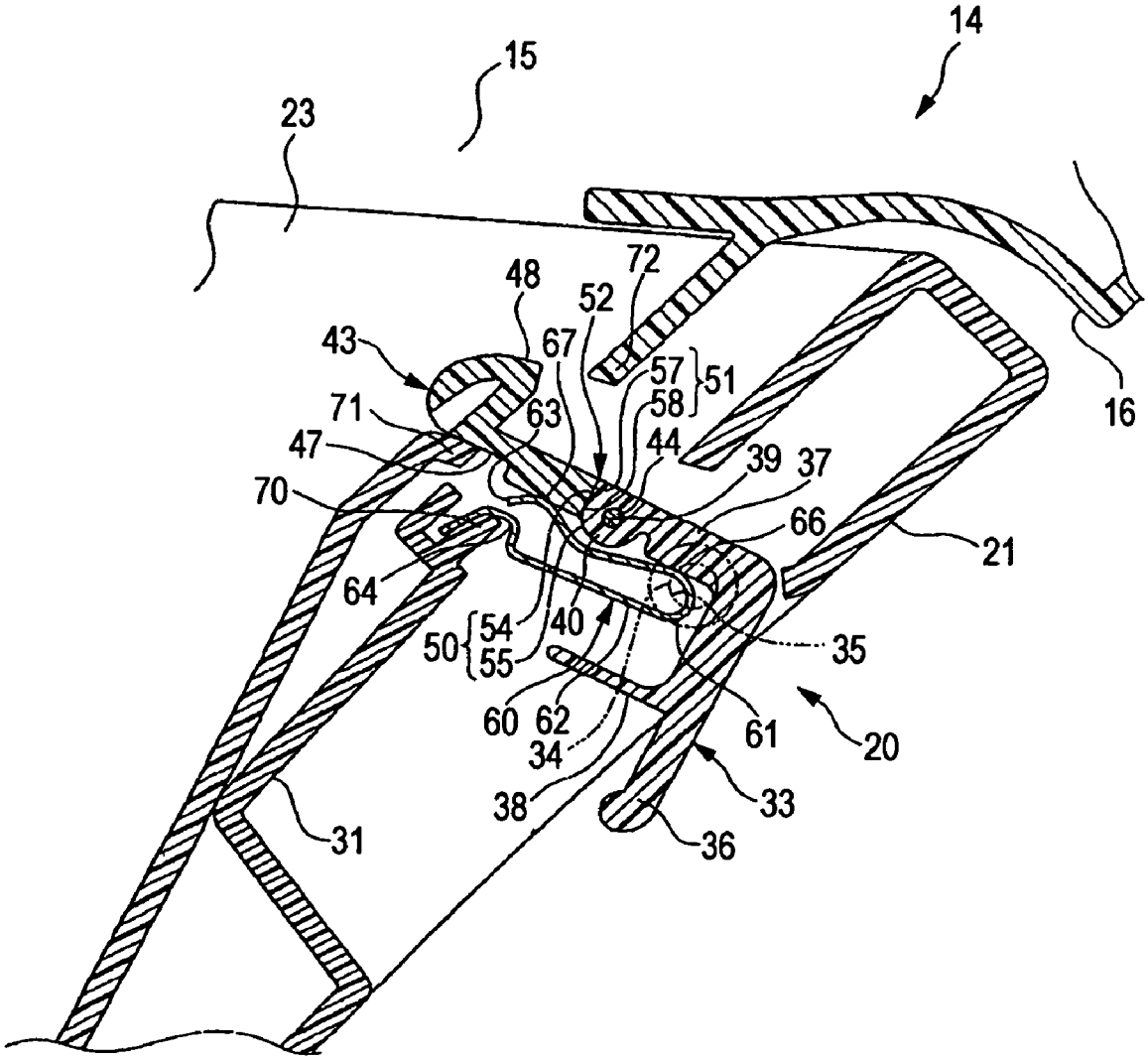
FIG. 5 is an enlarged side cross-sectional view showing a state where the knob member of the lid locking apparatus of the embodiment of the present invention is operated to be opened.

In this state, when the occupant pulls the knob member 33 of the lid 21 towards himself or herself to open the lid 21 which is closing the opening 16 in the console-side storage portion 15 in an attempt to cause the storage box 23 to project from the console-side storage portion 15, the knob member 33 and the lock member 43 swing about the support shaft portions 34 relative to the lid 21 while deforming the spring 60 in such a manner that the second plate portion 63 is caused to approach the first plate portion 62, as shown in FIG. 5. As this occurs, the abutment structure portions 52 provided on the lock member 43 and the knob member 33 are held in the abutment state by virtue of a biasing force inputted from the deforming spring 60 mainly via the second abutting raised portion 67 into the lock member 43. As a result, the lock member 43 swings together with the knob member 33, so that the locking pawl portion 48 is lowered and the engagement with the engagement portion 72 is released, whereby the lid 21 can be opened. Note that the lock member 43 and the knob member 33 swing in the opening direction until the lock member 43 is brought into abutment with the lower stopper portion 71 formed on the storage box 23. Then, when the occupant still continues to pull the lid 21 via the knob member 33, the lid 21 opens the opening 16, and the projecting state results in which the storage box 23 projects from the console-side storage portion 15. Note that when the occupant releases the pulling of the lid 21, the lock member 43 and the knob member 33 are brought into the aforesaid inoperative state by virtue of the biasing force of the spring 60 to thereby be returned to the closed position.

Figure 6:
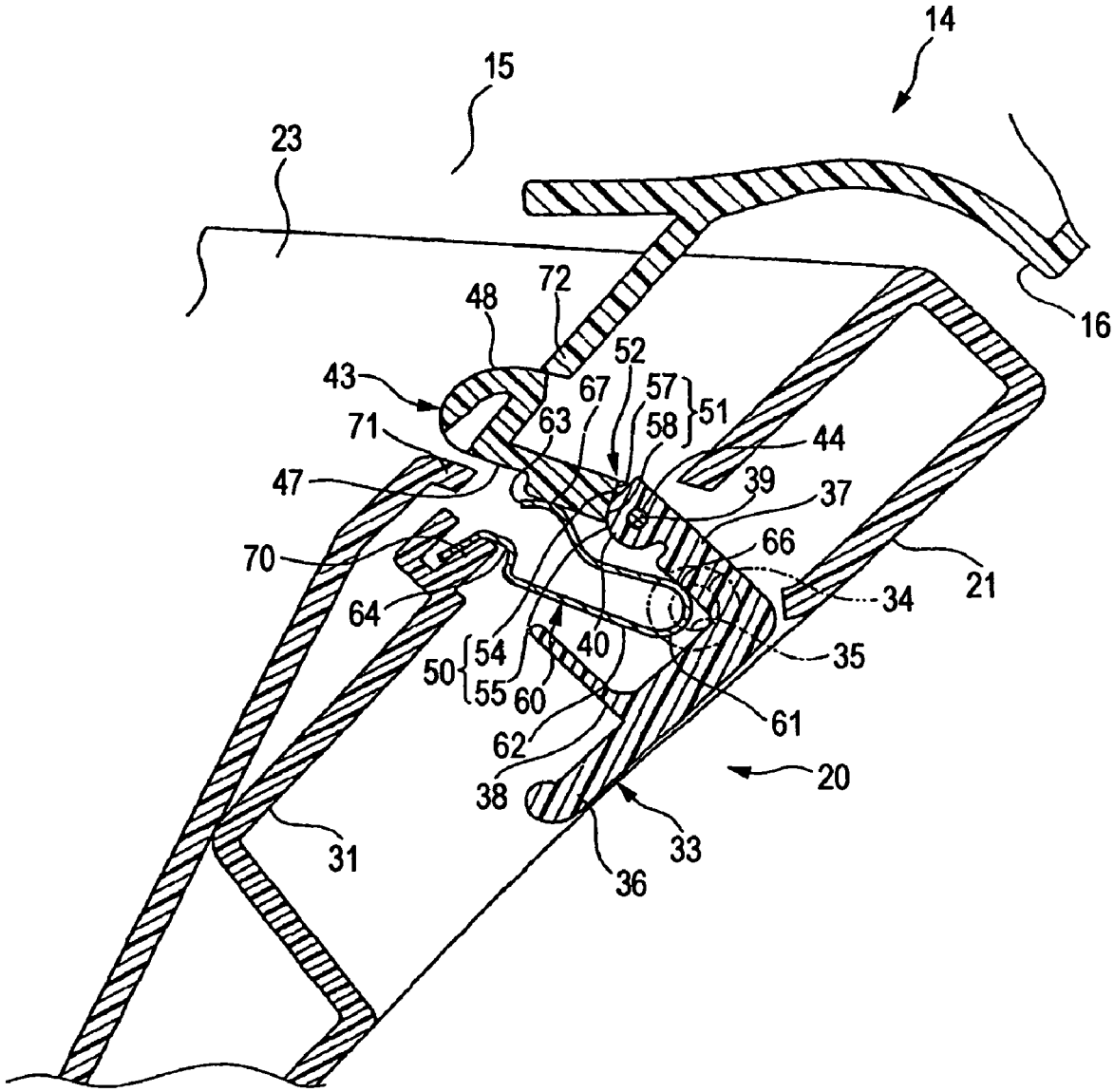
FIG. 6 is an enlarged side cross-sectional view showing a state where the lock member of the lid locking apparatus of the embodiment of the present invention rides on an engagement portion and FIG. 7 is an exploded perspective view showing a knob member and a lock member of a lid locking apparatus of another embodiment of the present invention.

On the other hand, in this state, when the occupant performs a closing operation to retract the storage box 23 into the console-side storage portion 15 to thereafter close the opening 16 with the lid 21, the locking pawl portion 48 of the lock member 43, which is in the inoperative state then, is brought into abutment with the engagement portion 72 in the console-side storage portion 15 and moves into underneath the engagement portion 72 while attempting to ride thereon, as shown in FIG. 6, just before the lid 21 has closed the opening 16. Thus, even in the event that the lock member 43 rides on the engagement portion 72 to swing in an attempt to be brought into engagement with the engagement portion 72, since the spring 60 forces the abutment structure portions 52 to separate from each other against the biasing force on the second abutting raised portion 67 side so as to bias the knob member 33 in the direction towards the closed position by virtue of the biasing force on the first abutting raised portion 66 side to thereby cause the lock member 43 to swing independently, the knob member 33 continues to be biased so as to stay at the closing position.

Then, when the locking pawl portion 48 finally rides over the engagement portion 72, the lock member 43 is returned to the closed position by virtue of the biasing force of the spring 60. Then, as shown in FIG. 4, the locking pawl portion 48 thereof is brought into engagement with the rear side of the engagement portion 72. As this occurs, the storage box 23 is retracted into the console-side storage portion 15, and the lid 21 of the storage box 23 is allowed to close the opening 16 in the console-side storage portion 15.

Thus, by operating as has been described heretofore, the spring 60 brings the abutment structure portions 52 into abutment with each other by generating the biasing force in the direction in which the abutment structure portions 52 are brought into abutment with each other, when the knob member 33 is situated at the closed position, and when the knob member 33 is operated to be opened from the closed position, the spring 60 causes the lock member 43 to swing together with the knob member 33 while the abutment structure portions 52 are held in the abutment with each other so as to release the engagement of the lock member 43 with the engagement portion 72. In addition, even in the event that the lock member 43 rides on the engagement portion 72 when the lid 21 is operated to be closed, the spring 60 biases the knob member 33 in the direction towards the closed position so as to bias the abutment structure portions 52 to separate from each other against the biasing force thereof to thereby cause the lock member 43 to swing independently.

Thus, as has been described heretofore, according to the lid locking apparatus of the first embodiment, when the lid 21 is operated to be closed, the swing of the knob member 33 can be prevented, and moreover, the generation of looseness in the knob member 33 can also be prevented, whereby a good operation feeling can be obtained.

Moreover, since only the single spring 60 is used, the number of components and costs can be reduced.

Figure 7:
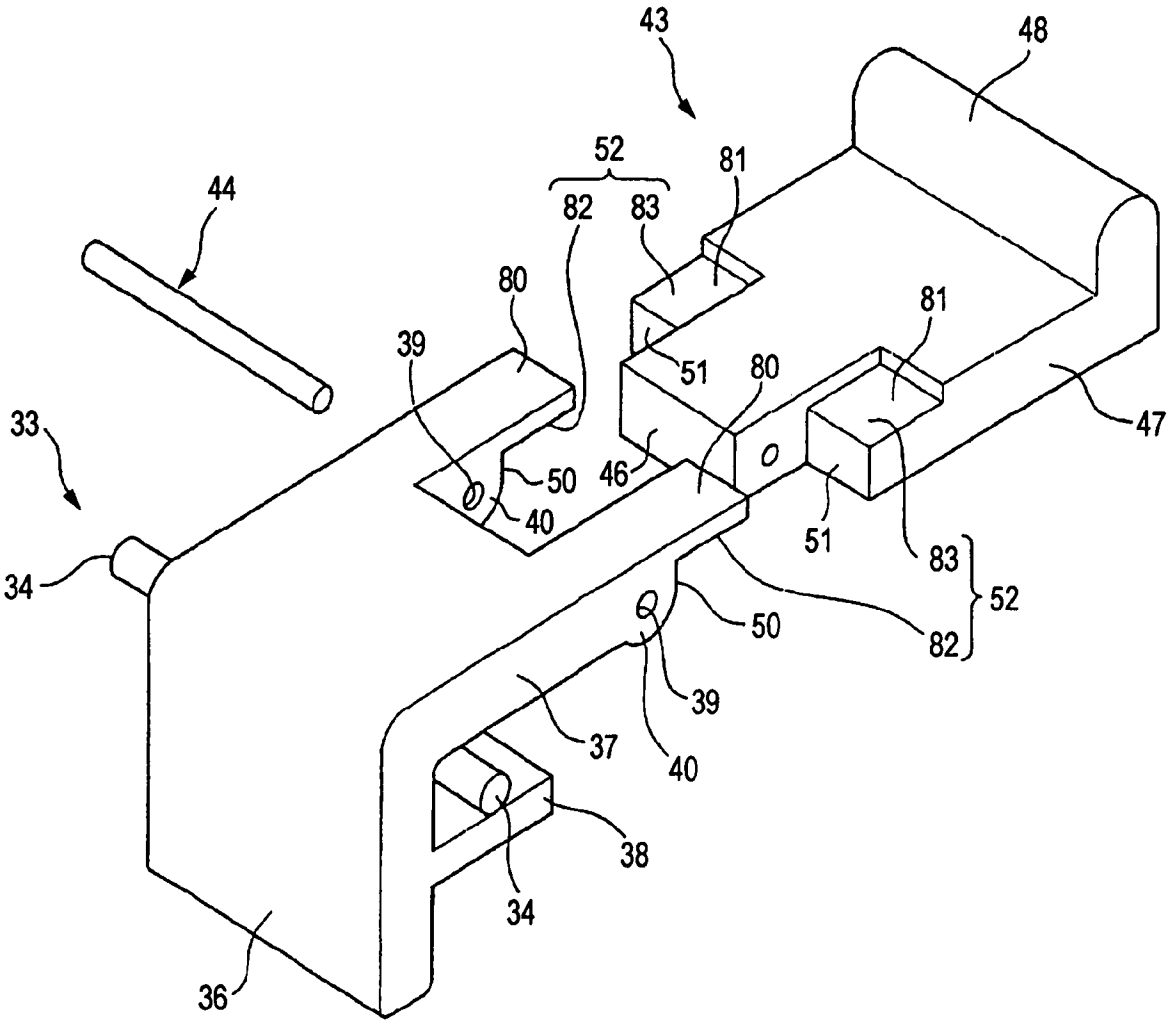

Next, referring mainly to FIG. 7, a lid locking apparatus according to a second embodiment of the invention will be described while focusing on differences from the first embodiment. Note that like reference numerals are imparted to like portions to those described in the first embodiment and the description thereof will be omitted.

The second embodiment differs from the first embodiment in abutment structure portions 52.

Namely, in the second embodiment, abutment piece portions 80 are formed on end faces 50 of connecting piece portions 40 of a knob member 33 which are situated at an end of an engagement plate portion 37 which is opposite to an operation plate portion 36 on sides thereof which are situated opposite to the operation plate portion 36 in a direction in which the operation plate portion 36 extends in such a manner as to extend along the engagement plate portion 37. In addition, abutment stepped portions 81 are formed on end faces 51 of an extending plate portion of a lock member 43 which are situated opposite to an locking pawl portion 48 on sides where the locking pawl portion 48 exists as viewed in a direction in which the locking pawl portion 48 projects in such a manner as to allow the abutment piece portions 80 to enter them. Then, abutment surface portions 82, which constitute bottom surfaces of the abutment piece portions 80, and abutment surface portions 83, which constitute top surfaces of the abutment stepped portions 81, constitute abutment structure portions 52 which can be brought into abutment with and separation from each other. Here, in an abutment state where the abutment surfaces 82 of the abutment piece portions 80 are in abutment with the abutment surface portions 83 of the abutment stepped portions 81, as in the case with the first embodiment, the engagement plate portion 37 of the knob member 33 and the extending plate portion 47 of the lock member 43 are disposed on the same plane, and the operation plate portion 36 of the knob member 33 and the locking pawl portion 48 of the lock member 43 are disposed opposite to each other relative to the engagement plate portion 37 and the extending plate portion 47. In addition, the engagement plate portion 37 and the extending plate portion 47 can swing about a pin 44 in directions to separate the abutment surface portions 82, 83 from each other.

Also in the second embodiment that has been described above, the same advantage as that of the first embodiment can be provided.

Note that while, in the embodiments, the invention has been described above by taking as an example the case where the single spring 60 is used, it is possible to provide separately a spring (a first biasing means) for biasing the abutment structure portions 52 in the direction in which the abutment structure portions 52 are put in the abutment state and a spring (a second biasing means) for biasing the knob member 33 in the direction towards the closed position so as to force the abutment structure portions 52 to separate from each other to thereby cause the lock member 43 to swing independently even in the event that the lock member 43 rides on the engagement portion 72 when the lid 21 is operated to be closed.

In addition, while, in the embodiments, the invention has been described by taking as an example the case where the invention is applied to the lid 21 for opening and closing the opening 16 in the console-side storage portion 15 of the center console 14, the invention can be applied to any lid, provided that the lid is used to open and close any opening in any storage portion in the vehicle.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

What is claimed is:

1. A lid locking apparatus comprising:

a storage member having an opening portion and an engagement portion;

a lid which opens or closes the opening portion;

a knob member swingably supported on the lid via a first shaft, the knob member having a first abutment portion;

a lock member swingably supported on the knob member via a second shaft, the lock member having a second abutment portion; and first and second biasing members, wherein when the lid is in a closed position, the lock member locks the lid by engaging with the engagement portion, when the knob member is in a closed position, the first biasing member biases the first and second abutment portions so as to abut each other to thereby lock the lid with the lock member, when the knob member is opened from the closed position, the first biasing member biases to swing the lock member and the knob member integrally with the first and second abutment portions being held in abutment with each other to thereby release the engagement with the engagement portion and the lock member, and when the lid is closed, the second biasing member biases the knob member in a direction towards the closed position thereof to separate the first and second abutment portions each other against the biasing force of the first biasing member to thereby allow the lock member to swing independently even in the event that the lock member rides on the engagement portion.

2. A lid locking apparatus as set forth in claim 1, wherein the first and second biasing members forms a single spring.

3. A lid locking apparatus as set forth in claim 2, wherein the spring is disposed so as to contact with the lid, the knob member and the lock member.

4. A lid locking apparatus as set forth in claim 2, wherein the spring is a plate spring.

5. A lid locking apparatus as set forth in claim 1, wherein the knob member and the lock member are formed separately.

6. A lid locking apparatus as set forth in claim 1, wherein the first abutment portion is provided on a surface of the knob member which opposes to the lock member.

7. A lid locking apparatus as set forth in claim 1, wherein when the first and second abutment portions abut each other, the knob member and the lock members are restricted from swinging in an abutment direction.

8. A lid locking apparatus as set forth in claim 1, wherein the storage member includes a main body portion and a storage portion, and the storage portion is swingably supported on the main body portion.

9. A lid locking apparatus as set forth in claim 8, wherein the engagement portion is provided on the main body portion, and the opening is provided on the storage portion.

10. A lid locking apparatus as set forth in claim 1, wherein the knob member includes:

a connecting portion which connects to the lock member;

an operable portion which extends so as to be substantially parallel to the lid; and an extending portion which extends from an intermediate portion of the operable portion toward the lid.

11. A lid locking apparatus as set forth in claim 10, wherein the first and second biasing members forms a single spring having a curvature portion, and the curvature portion is disposed between the connecting portion and the intermediate portion.

* * * * *

UNITED STATES PATENT AND TRADEMARK OFFICE

CERTIFICATE OF CORRECTION

PATENT NO. : 7,093,865 B2
APPLICATION NO. : 11/004524
DATED : August 22, 2006
INVENTOR(S) : Furuya It is certified that error appears in the above-identified patent and that said Letters Patent is hereby corrected as shown below:

On the Title Page, insert --(30) Foreign Application Priority Data, Dec. 18, 2003 (JP) 2003-420876--.

Signed and Sealed this

Thirtieth Day of January, 2007

JON W. DUDAS
*Director of the United States Patent and Trademark Office*